US010032572B2

(12) United States Patent
Chen et al.

(10) Patent No.: US 10,032,572 B2
(45) Date of Patent: Jul. 24, 2018

(54) SEALING MECHANISM AND PUSH-BUTTON DEVICE

(71) Applicant: Siemens Aktiengesellschaft, München (DE)

(72) Inventors: Zhong Hui Chen, Suzhou (CN); Zi Qi Chu, Suzhou (CN); Zhi Xing Ruan, Fujian (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 41 days.

(21) Appl. No.: 15/022,580

(22) PCT Filed: Jan. 15, 2014

(86) PCT No.: PCT/CN2014/070667
§ 371 (c)(1),
(2) Date: Mar. 17, 2016

(87) PCT Pub. No.: WO2015/106411
PCT Pub. Date: Jul. 23, 2015

(65) Prior Publication Data

US 2016/0314915 A1 Oct. 27, 2016

(51) Int. Cl.
*H01H 13/06* (2006.01)
*H01H 9/04* (2006.01)
(Continued)

(52) U.S. Cl.
CPC ..... *H01H 13/06* (2013.01); *H01H 9/041* (2013.01); *H01H 13/023* (2013.01); *H01H 13/10* (2013.01); *H01H 13/70* (2013.01)

(58) Field of Classification Search
CPC ..... H01H 13/06; H01H 9/041; H01H 13/70; H01H 13/10; H01H 13/023; H01H 9/02;
(Continued)

(56) References Cited

U.S. PATENT DOCUMENTS 4,088,855 A * 5/1978 Emery ..... H01H 1/242 200/16 A
5,053,591 A * 10/1991 Theurer ..... H01H 23/025 200/302.3
(Continued)

FOREIGN PATENT DOCUMENTS

CN 2770061 Y 4/2006
CN 102084448 A 6/2011
(Continued)

OTHER PUBLICATIONS

International Search Report PCT/ISA/210 for International Application No. PCT/CN2014/070667 dated Oct. 21, 2014.
(Continued)

*Primary Examiner* — Edwin A. Leon
(74) *Attorney, Agent, or Firm* — Harness, Dickey & Pierce, P.L.C.

(57) ABSTRACT

A sealing mechanism is suitable for a key device. The key device contains a key base, and the sealing mechanism contains one front ring shell, one lamp base shell and one sealing member. The front ring shell is installed on the key base, and the lamp base shell is installed on the front ring shell. The sealing member contains a sealing body and a sealing wall. The sealing wall is circularly arranged around the sealing body so as to be fixed on the lamp base shell. When the lamp base shell is installed on the front ring shell, the lamp base shell and the front ring shell respectively push the periphery of the sealing body, so that the sealing body and the front ring shell jointly form one sealing space so as to seal one first open groove on the key base.

25 Claims, 6 Drawing Sheets

(51) Int. Cl.
*H01H 13/02* (2006.01)
*H01H 13/10* (2006.01)
*H01H 13/70* (2006.01)

(58) Field of Classification Search
CPC .... H01H 9/161; H01H 11/0006; H02B 15/00; H01R 23/26
USPC ..... 200/302.2, 293, 302.1
See application file for complete search history.

(56) References Cited

U.S. PATENT DOCUMENTS

| | | | | |
|---|---|---|---|---|
| 5,662,213 | A * | 9/1997 | Kattler | H01H 23/06 200/302.3 |
| 5,722,533 | A * | 3/1998 | Gallone | H01H 13/06 200/296 |
| 6,444,932 | B1 * | 9/2002 | Resmalm | H01H 3/022 200/296 |

FOREIGN PATENT DOCUMENTS

| | | | |
|---|---|---|---|
| CN | 201975301 | U | 9/2011 |
| CN | 202870813 | U | 4/2013 |
| DE | 3041470 | A1 | 6/1982 |
| DE | 4208088 | C1 | 4/1993 |
| DE | 29823961 | U1 | 2/2000 |
| FR | 2503446 | A1 | 10/1982 |
| JP | 2010108749 | A | 5/2010 |

OTHER PUBLICATIONS

Written Opinion of the International Searching Authority PCT/ISA/237 for International Application No. PCT/CN2014/070667 dated Oct. 21, 2014.
Chinese Office Action dated Feb. 16, 2017.
Extended European Search Report for European Patent Application No. 14879222.9 dated Nov. 29, 2017.

* cited by examiner

SEALING MECHANISM AND PUSH-BUTTON DEVICE

PRIORITY STATEMENT

This application is the national phase under 35 U.S.C. § 371 of PCT International Application No. PCT/CN2014/070667 which has an International filing date of Jan. 15, 2014, which designated the United States of America, the entire contents of which are hereby incorporated herein by reference.

FIELD

An embodiment of the present invention generally relates to a sealing mechanism and a push-button device, in particular to a sealing mechanism capable of forming a sealing space inside a push-button device, and/or a push-button device.

BACKGROUND

In general, a double-push-button device may be applied to a man-machine interface of industrial equipment (e.g. a machine tool), to enable a user to control the industrial equipment via the double-push-button device, e.g. to energize or de-energize the industrial equipment. The double-push-button device is provided with a sealing pad, for blocking the ingress of foreign matter (e.g. water or dust) into the interior of the double-push-button device, to further prevent foreign matter from causing damage to a push-button assembly as a result of entering the interior of the double-push-button device. However, a through-hole is formed in a well-known sealing pad, and will make the formation of a sealing space by the sealing pad during sealing impossible, thereby making it impossible for the sealing pad to effectively block the ingress of foreign matter into the interior of the double-push-button device.

SUMMARY

A sealing mechanism is provided which is capable of forming a sealing space inside a push-button device, and a push-button device is also provided.

In at least one embodiment, the present invention discloses a sealing mechanism suitable for use in a push-button device, the push-button device comprising a push-button base, the sealing mechanism comprising a front ring shell, a lamp base shell and a sealing member. The front ring shell is mounted on the push-button base, and the lamp base shell is mounted on the front ring shell. The sealing member comprises a sealing body and a sealing wall, the sealing wall being annularly disposed on the sealing body and fixed to the lamp base shell. When the lamp base shell is mounted on the front ring shell, the lamp base shell and the front ring shell respectively push the periphery of the sealing body, so that the sealing body and the front ring shell together form a sealing space, to seal a first slot in the push-button base.

According to one of the embodiments of the present invention, a push-button device is disclosed comprising a push-button base and a sealing mechanism, a first slot being formed in the push-button base, and the sealing mechanism comprising a front ring shell, a lamp base shell and a sealing member. The front ring shell is mounted on the push-button base, and the lamp base shell is mounted on the front ring shell. The sealing member comprises a sealing body and a sealing wall, the sealing wall being annularly disposed on the sealing body and fixed to the lamp base shell; when the lamp base shell is mounted on the front ring shell, the lamp base shell and the front ring shell respectively push the periphery of the sealing body, so that the sealing body and the front ring shell together form a sealing space, to seal the first slot in the push-button base.

Figure 1:
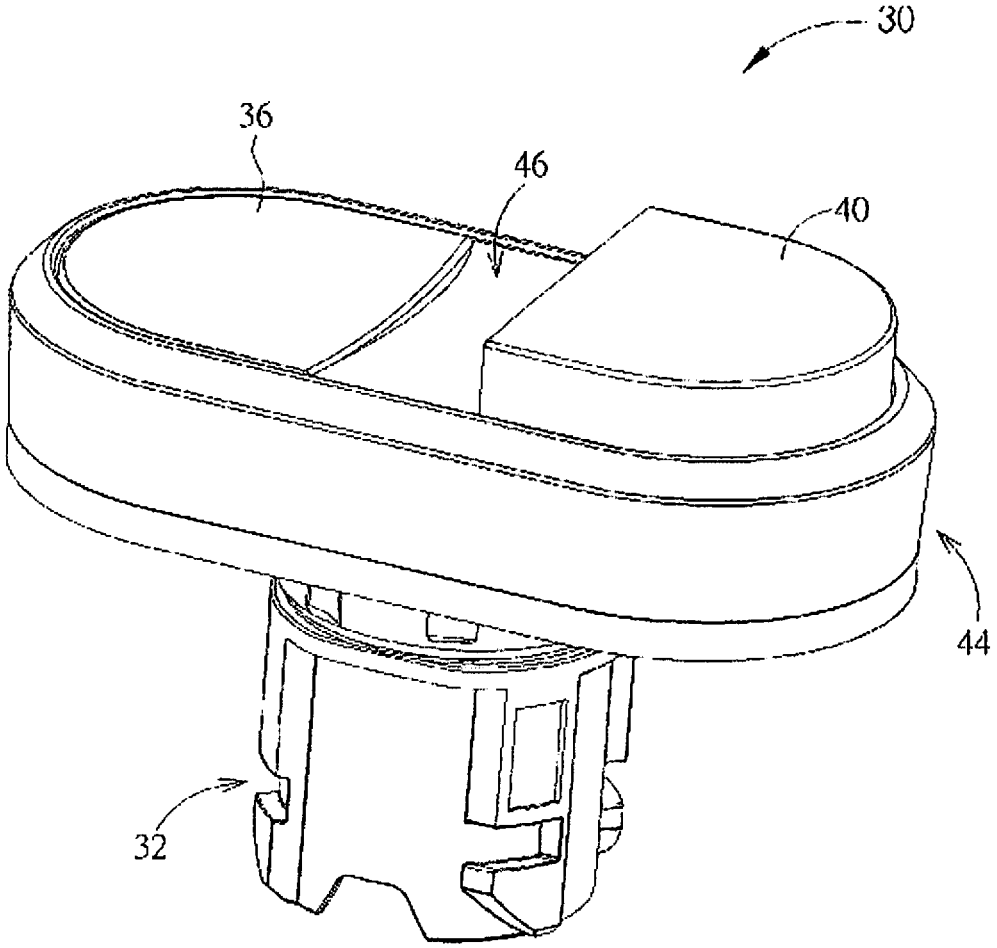
FIG. 1 is a schematic view of the appearance of a push-button device in an embodiment of the present invention.

Push-button to the labels in the accompanying drawings:

| | |
|---|---|
| 30 | push-button device |
| 32 | push-button base |
| 321 | first slot |
| 323 | second slot |
| 34 | sealing mechanism |
| 36 | first push-button cover |
| 361 | first guide post |
| 363 | first sliding engagement hook |
| 365 | first trigger part |
| 38 | first push-pin |
| 40 | second push-button cover |
| 401 | second guide post |
| 403 | second sliding engagement hook |
| 405 | second trigger part |
| 42 | second push-pin |
| 44 | front ring shell |
| 441 | first through-hole |
| 443 | first engagement slot |
| 445 | second through-hole |
| 447 | second engagement slot |
| 46 | lamp base shell |
| 461 | fixing ring structure |
| 463 | engagement hook structure |
| 48 | sealing member |
| 50 | sealing body |
| 501 | first surface |
| 503 | second surface |
| 505 | elastic connecting part |
| 52 | sealing wall |
| 54 | first rib part |
| 56 | second rib part |
| 58 | first abutment part |
| 60 | second abutment part |
| S | sealing space |

DETAILED DESCRIPTION OF THE EXAMPLE EMBODIMENTS

In at least one embodiment, the present invention discloses a sealing mechanism suitable for use in a push-button device, the push-button device comprising a push-button base, the sealing mechanism comprising a front ring shell, a lamp base shell and a sealing member. The front ring shell is mounted on the push-button base, and the lamp base shell is mounted on the front ring shell. The sealing member comprises a sealing body and a sealing wall, the sealing wall being annularly disposed on the sealing body and fixed to the lamp base shell. When the lamp base shell is mounted on the front ring shell, the lamp base shell and the front ring shell respectively push the periphery of the sealing body, so that the sealing body and the front ring shell together form a sealing space, to seal a first slot in the push-button base.

According to one of the embodiments of the present invention, the sealing body includes a first surface and a second surface opposite the first surface, the first surface and the second surface abutting a first push-button cover and a first push-pin of the push-button device respectively, and the second surface and the front ring shell together defining the sealing space.

According to one of the embodiments of the present invention, the sealing member further comprises a first abutment part, disposed in a position on the sealing body which corresponds to the first push-pin, and two sides of the first abutment part protrude from the first surface and the second surface and abut the first push-button cover and the first push-pin respectively.

According to one of the embodiments of the present invention, the thickness of the first abutment part is greater than the thickness of the sealing body.

According to one of the embodiments of the present invention, the sealing space further seals a second slot in the push-button base, and the first surface and the second surface further abut a second push-button cover and a second push-pin of the push-button device respectively, and the sealing member further comprises a second abutment part, disposed in a position on the sealing body which corresponds to the second push-pin, and two sides of the second abutment part protrude from the first surface and the second surface and abut the second push-button cover and the second push-pin respectively.

According to one of the embodiments of the present invention, the sealing body further has an elastic connecting part, which connects the first abutment part and the second abutment part.

According to one of the embodiments of the present invention, the sealing member further comprises a first rib part, disposed at the junction of the sealing body and the sealing wall and projecting towards the lamp base shell.

According to one of the embodiments of the present invention, the sealing member further comprises a second rib part, disposed at the junction of the sealing body and the sealing wall and projecting towards the front ring shell.

According to one of the embodiments of the present invention, the lamp base shell has a fixing ring structure which is surrounded by the sealing wall.

According to one of the embodiments of the present invention, the lamp base shell further has multiple engagement hook structures, which engage the front ring shell, so that the fixing ring structure pushes down the periphery of the sealing body against the front ring shell.

According to one of the embodiments of the present invention, a push-button device is disclosed comprising a push-button base and a sealing mechanism, a first slot being formed in the push-button base, and the sealing mechanism comprising a front ring shell, a lamp base shell and a sealing member. The front ring shell is mounted on the push-button base, and the lamp base shell is mounted on the front ring shell. The sealing member comprises a sealing body and a sealing wall, the sealing wall being annularly disposed on the sealing body and fixed to the lamp base shell; when the lamp base shell is mounted on the front ring shell, the lamp base shell and the front ring shell respectively push the periphery of the sealing body, so that the sealing body and the front ring shell together form a sealing space, to seal the first slot in the push-button base.

In summary, the sealing mechanism of at least one of the embodiments of the present invention utilizes the front ring shell and the lamp base shell to respectively compress the periphery of the sealing body of the sealing member during assembly, so that the sealing body and the front ring shell together form a sealing space, to seal the first slot and the second slot in the push-button base. Thus, the sealing member can be used to seal the first slot and the second slot in the push-button base, to block the ingress of foreign matter (e.g. water or dust) into the interior of the push-button base of the push-button device, to further prevent foreign matter from causing damage to a push-button assembly as a result of entering the interior of the push-button base. The abovementioned and other technical content, features and effects of the present invention will be presented clearly in the following detailed explanation of embodiments which makes reference to the accompanying drawings.

The directional terms mentioned in the following embodiments, for example up, down, left, right, front or rear, only refer to the accompanying drawings. Thus, the directional terms used are intended to explain, not to restrict, embodiments of the present invention.

Figure 2:
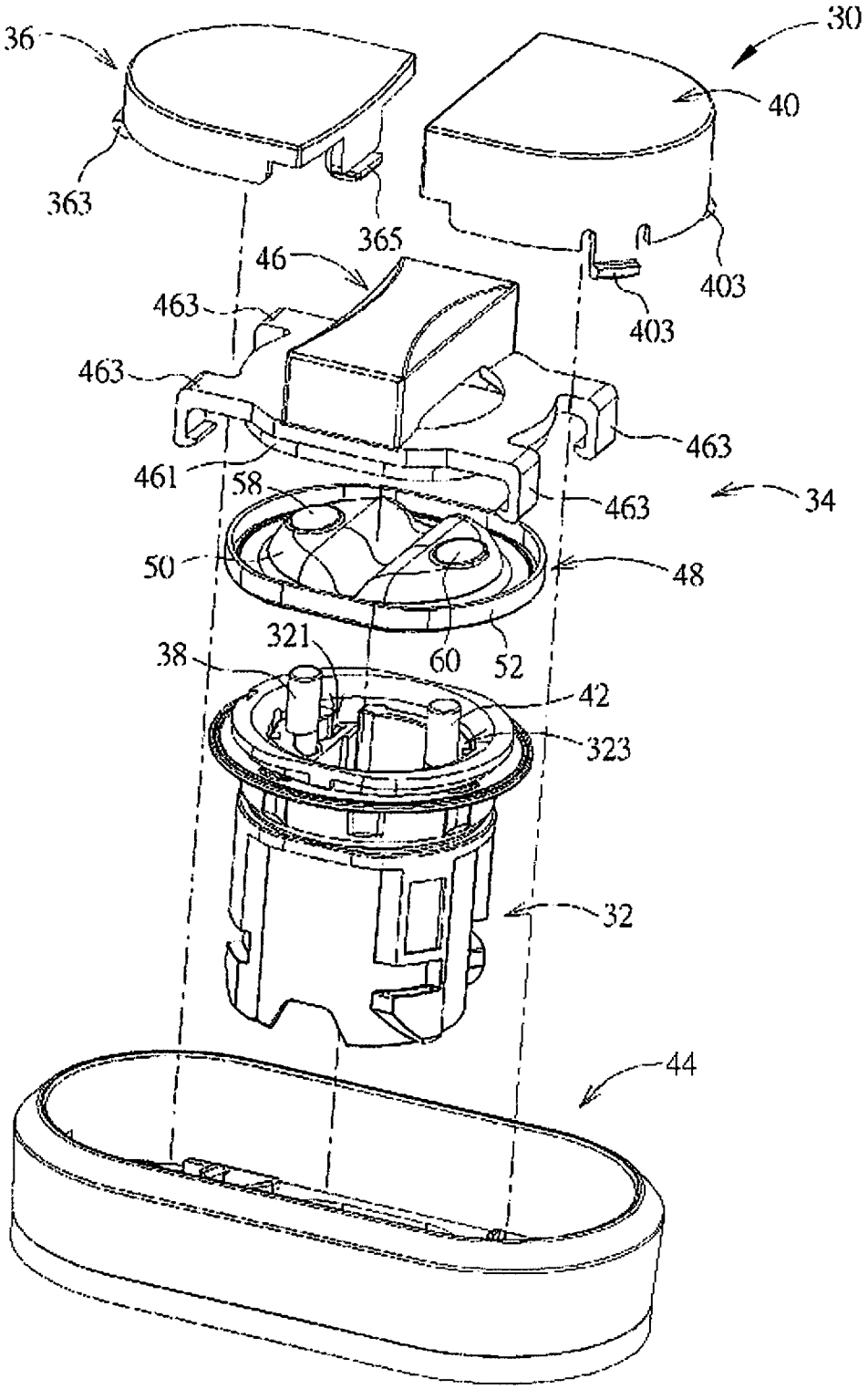
FIG. 2 is a schematic exploded view of a push-button device in an embodiment of the present invention.
Figure 3:
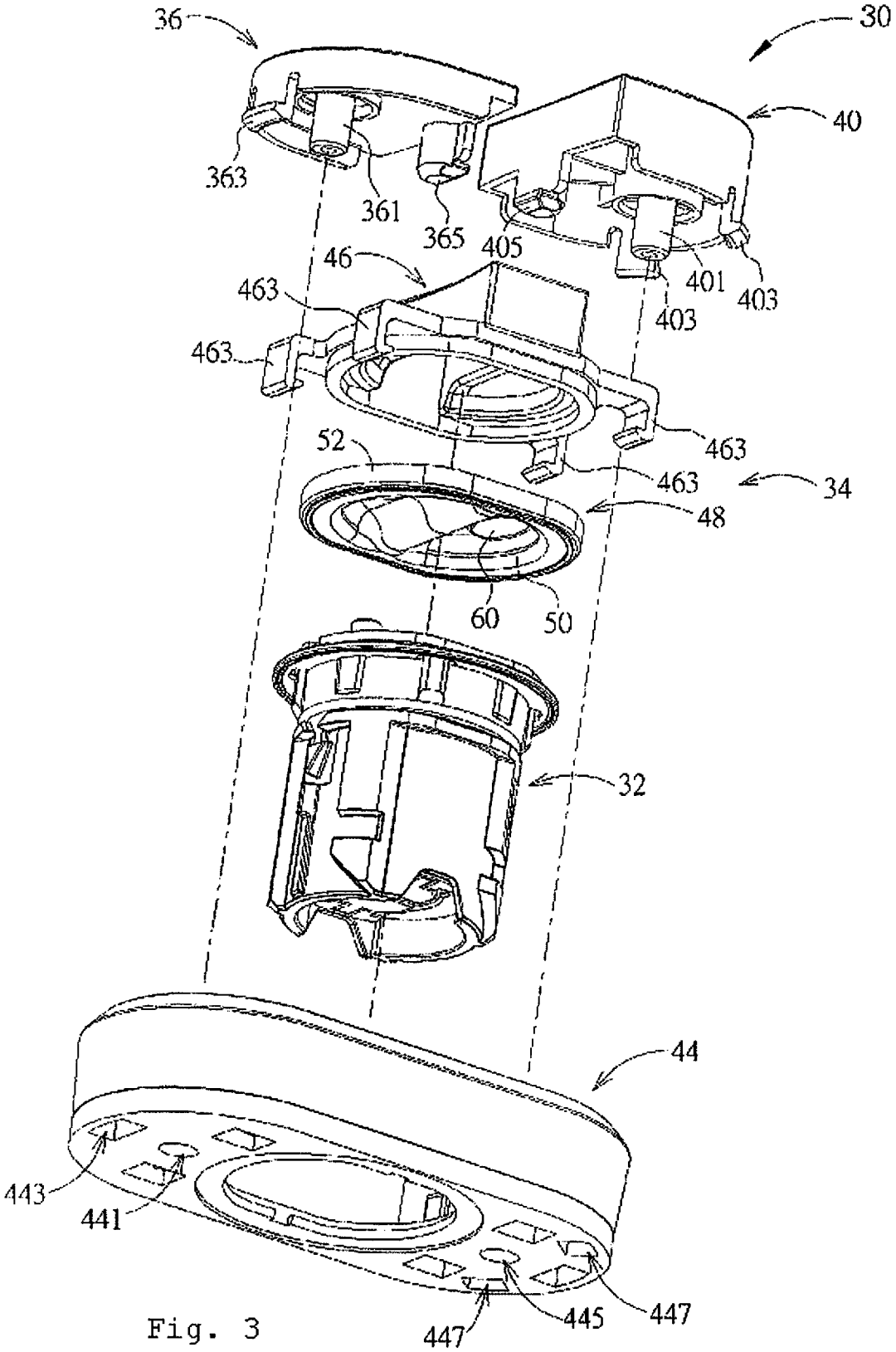
FIG. 3 is a schematic exploded view from another angle of a push-button device in an embodiment of the present invention.

Please refer to FIGS. 1 to 3: FIG. 1 is a schematic view of the appearance of a push-button device 30 in an embodiment of the present invention, FIG. 2 is a schematic exploded view of a push-button device 30 in an embodiment of the present invention, and FIG. 3 is a schematic exploded view from another angle of a push-button device 30 in an embodiment of the present invention. In this embodiment, the push-button device 30 may be a double-push-button device, i.e. the push-button device 30 may contain two push-buttons, and is used in a man-machine interface of industrial equipment (e.g. a machine tool). The use of the push-button device 30 of the present invention need not be limited to that shown in the accompanying drawings of this embodiment, e.g. the push-button device 30 may also be a single-push-button device. With regard to which of the above designs is used, this is determined according to actual demands.

As FIGS. 1 to 3 show, the push-button device 30 comprises a push-button base 32, a sealing mechanism 34, a first push-button cover 36, a first push-pin 38, a second push-button cover 40 and a second push-pin 42; the sealing mechanism 34 comprises a front ring shell 44 and a lamp base shell 46, and a first slot 321 and a second slot 323 are formed on the push-button base 32. Furthermore, the front ring shell 44 is mounted on the push-button base 32, the lamp base shell 46 is mounted on the front ring shell 44, the first push-button cover 36 is disposed above the lamp base shell 46, the first push-pin 38 is slidably disposed in the first slot 321 in the push-button base 32 and corresponds to the first push-button cover 36, the second push-button cover 40 is disposed above the lamp base shell 46 and is adjacent to the first push-button cover 36, and the second push-pin 42 is slidably disposed in the second slot 323 in the push-button base 32 and corresponds to the second push-button cover 40.

Figure 4:
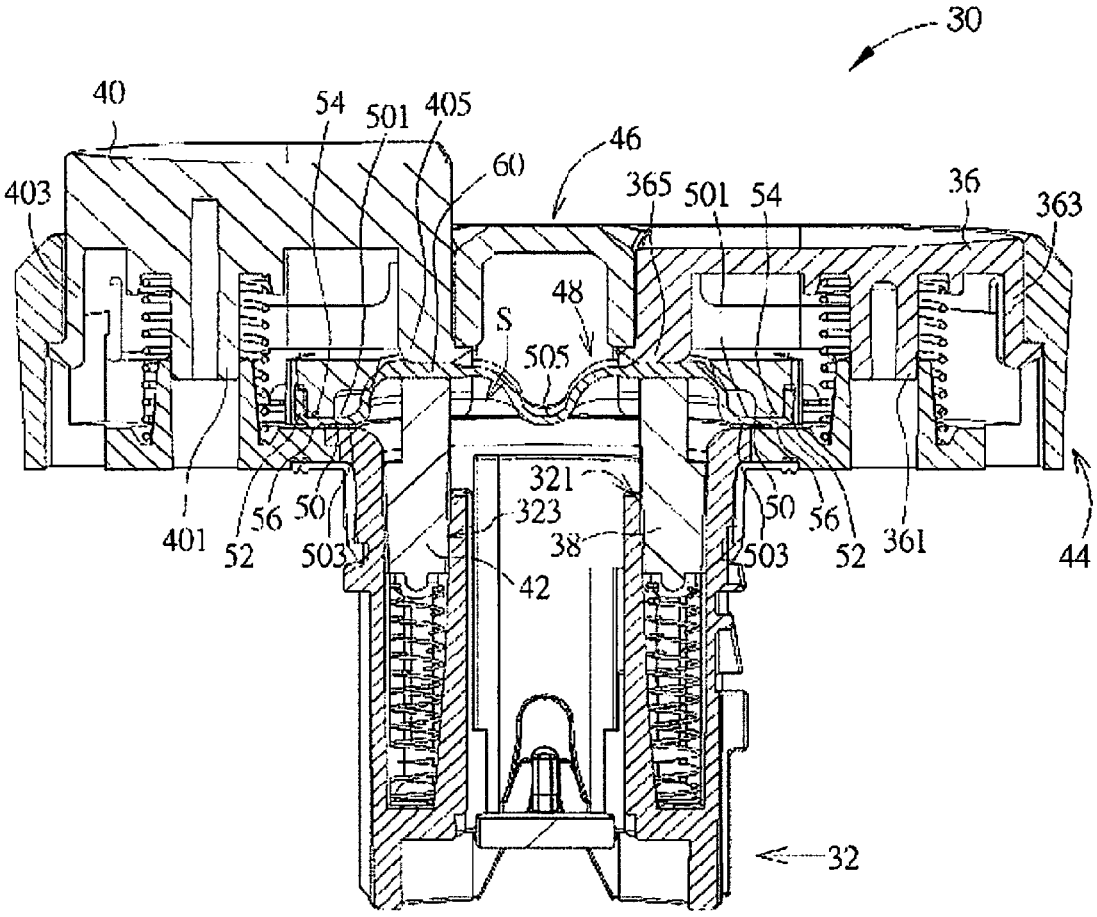
FIG. 4 is a sectional schematic view of a push-button device in an embodiment of the present invention.

Please refer to FIGS. 2 to 4; FIG. 4 is a sectional schematic view of a push-button device 30 in an embodiment of the present invention. As FIGS. 2 to 4 show, the first push-button cover 36 comprises a first guide post 361 and a first sliding engagement hook 363, a first through-hole 441 and a first engagement slot 443 are formed in the front ring shell 44, the first through-hole 441 corresponding to the first guide post 361, and the first engagement slot 443 corresponding to the first sliding engagement hook 363. When the first push-button cover 36 and the front ring shell 44 are fitted together, the first guide post 361 may be slidably passed into the first through-hole 441, so that the first push-button cover 36 moves up and down relative to the front ring shell 44, and the first sliding engagement hook 363 is slidably disposed in the first engagement slot 443, to prevent disengagement of the first push-button cover 36 from the front ring shell 44. The numbers and positions of the first guide post 361, the first sliding engagement hook 363, the first through-hole 441 and the first engagement slot 443 of the present invention need not be limited to those shown in the accompanying drawings of this embodiment, but are determined according to actual demands.

In addition, the second push-button cover 40 comprises a second guide post 401 and two second sliding engagement hooks 403, a second through-hole 445 and two second engagement slots 447 are formed in the front ring shell 44, the second through-hole 445 corresponding to the second guide post 401, and the second engagement slots 447 corresponding to the second sliding engagement hooks 403. When the second push-button cover 40 and the front ring shell 44 are fitted together, the second guide post 401 may be slidably passed into the second through-hole 445, so that the second push-button cover 40 moves up and down relative to the front ring shell 44, and the two second sliding engagement hooks 403 are slidably disposed in the two second engagement slots 447 respectively, to prevent disengagement of the second push-button cover 40 from the front ring shell 44. The numbers and positions of the second guide post 401, the second sliding engagement hook 403, the second through-hole 445 and the second engagement slot 447 of the present invention need not be limited to those shown in the accompanying drawings of this embodiment, but are determined according to actual demands.

As shown in FIGS. 2 to 4, the sealing mechanism 34 further comprises a sealing member 48 disposed between the front ring shell 44 and the lamp base shell 46, the sealing member 48 comprising a sealing body 50 and a sealing wall 52, the sealing wall 52 being disposed annularly on the sealing body 50. In actual application, the sealing wall 52 may be fixed to the lamp base shell 46, whereby the sealing member 48 can be fixed to the lamp base shell 46 in advance, so as to perform subsequent assembly. In this embodiment, the lamp base shell 46 may have a fixing ring structure 461. When the sealing member 48 and the lamp base shell 46 are fitted together, the sealing wall 52 of the sealing member 48 can surround the fixing ring structure 461 of the lamp base shell 46, so as to fix the sealing member 48 to the lamp base shell 46. The structural design whereby the sealing member 48 is fixed to the lamp base shell 46 need not be limited to that shown in the accompanying drawings of this embodiment, but is determined according to actual demands. In this embodiment, the sealing member 48 may be made from thermoplastic urethane (TPU) material, which is highly oil-resistant and does not readily change color after irradiation by ultraviolet rays, but the present invention is not limited to this.

Figure 5:
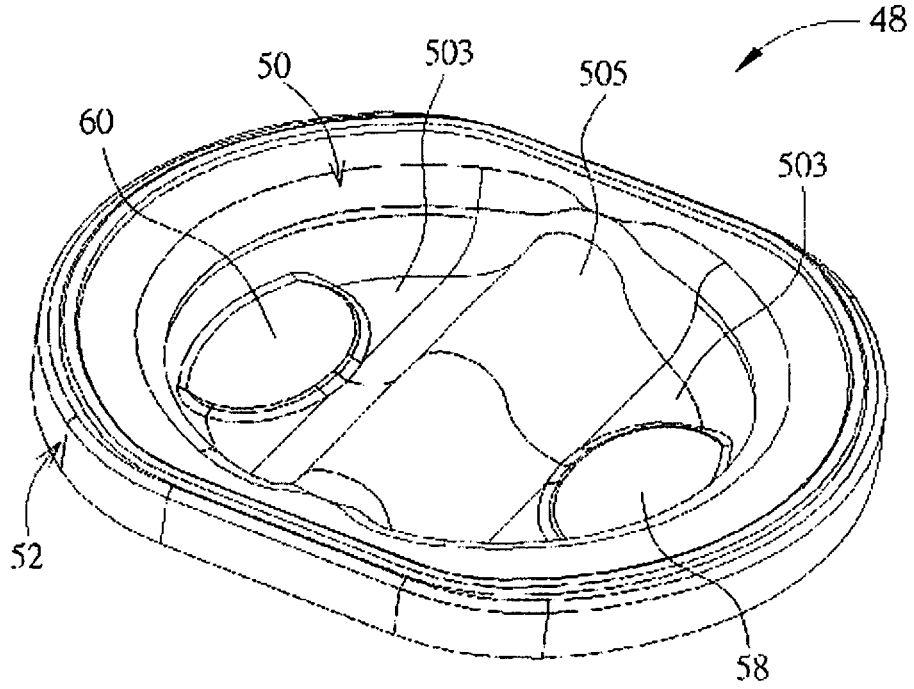
FIG. 5 is a schematic view of a sealing member in an embodiment of the present invention.
Figure 6:
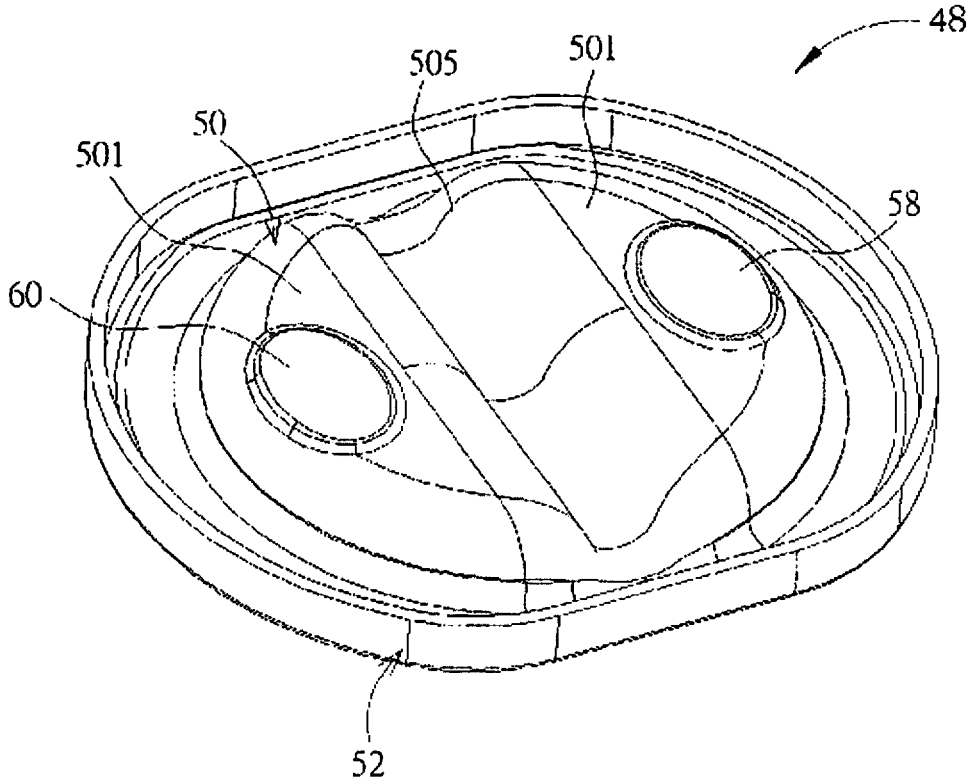
FIG. 6 is a schematic view from another angle of a sealing member in an embodiment of the present invention.

Please refer to FIGS. 4 to 6; FIG. 5 is a schematic view of a sealing member 48 in an embodiment of the present invention, and FIG. 6 is a schematic view from another angle of a sealing member 48 in an embodiment of the present invention. As FIGS. 4 to 6 show, the lamp base shell 46 may further have multiple engagement hook structures 463, and the sealing body 50 has a first surface 501 and a second surface 503 opposite the first surface 501. In addition, the sealing member 48 further comprises a first rib part 54 and a second rib part 56, the first rib part 54 being disposed at the junction of the sealing body 50 and the sealing wall 52 and projecting towards the lamp base shell 46, and the second rib part 56 being disposed at the junction of the sealing body 50 and the sealing wall 52 and projecting towards the front ring shell 44.

After fixing the sealing member 48 to the lamp base shell 46, the lamp base shell 46 can be further fitted to the front ring shell 44, at which time the engagement hook structures 463 of the lamp base shell 46 may be used to engage the front ring shell 44, so that the fixing ring structure 461 of the lamp base shell 46 pushes down the periphery of the sealing body 50 of the sealing member 48 against the front ring shell 44. In other words, when the lamp base shell 46 is mounted on the front ring shell 44, the lamp base shell 46 and the front ring shell 44 can respectively push the periphery of the sealing body 50 of the sealing member 48 through the action of the engagement hook structures 463 engaging with the front ring shell 44; at this time the sealing body 50 of the sealing member 48 and the front ring shell 44 can together form a sealing space S, to seal the first slot 321 and second slot 323 in the push-button base 32.

Thus, the sealing member 48 can be used to seal the first slot 321 and the second slot 323 in the push-button base 32, to block the ingress of foreign matter (e.g. water or dust) into the interior of the push-button base 32 of the push-button device 30, to further prevent foreign matter from causing damage to a push-button assembly as a result of entering the interior of the push-button base 32. As FIG. 4 shows, when the sealing body 50 and the front ring shell 44 together form the sealing space S, the first surface 501 and the second surface 503 of the sealing body 50 abut the first push-button cover 36 and the first push-pin 38 respectively; and the first surface 501 and the second surface 503 of the sealing body 50 abut the second push-button cover 40 and the second push-pin 42 respectively.

In other words, the first push-button cover 36 and the first push-pin 38 abut the first surface 501 and the second surface 503 of the sealing body 50 respectively without contacting each other, and the second push-button cover 40 and the second push-in 42 abut the first surface 501 and the second surface 503 of the sealing body 50 respectively without contacting each other, therefore there is no need to provide holes in the sealing body 50 for the first push-button cover 36 and the first push-pin 38 to pass through and for the second push-button cover 40 and the second push-pin 42 to pass through, whereby the above design can further enhance the sealing effect of the sealing member 48. In addition, the second surface 503 of the sealing body 50 can define the sealing space S together with the front ring shell 44, and since the second surface 503 is a complete surface, the second surface 503 can define a complete sealing space S together with the front ring shell 44, so as to further enhance the sealing effect of the sealing member 48.

In addition, when the lamp base shell 46 and the front ring shell 44 respectively push the periphery of the sealing body 50 of the sealing member 48, the first rib part 54 and second rib part 56 of the sealing member 48 can be compressed and thereby deformed by the lamp base shell 46 and the front ring shell 44 respectively, so as to be flat against the lamp base shell 46 and the front ring shell 44.

In other words, when the lamp base shell 46 and the front ring shell 44 respectively push the periphery of the sealing body 50 of the sealing member 48, the first rib part 54 and second rib part 56 of the sealing member 48 can be compressed by the lamp base shell 46 and the front ring shell 44 so as to be flat against the lamp base shell 46 and the front ring shell 44, to further enhance the sealing effect of the sealing member 48.

As shown in FIGS. 4 to 6, the sealing member 48 further comprises a first abutment part 58, and the first push-button cover 36 has a first trigger part 365. The first abutment part 58 is disposed in a position on the sealing body 50 which corresponds to the first push-pin 38, and two sides of the first abutment part 58 protrude from the first surface 501 and the second surface 503 of the sealing body 50. When a user presses the first push-button cover 36, the two sides of the first abutment part 58 can abut the first trigger part 365 of the first push-button cover 36 and the first push-pin 38 respectively, so that the first trigger part 365 of the first push-button cover 36 drives the first push-pin 38 via the first abutment part 58, to trigger a switch in the push-button base 32 (not shown in the figures).

It is worth mentioning that since the two sides of the first abutment part 58 protrude from the first surface 501 and the second surface 503 of the sealing body 50, i.e. the thickness of the first abutment part 58 is greater than the thickness of the sealing body 50, the first abutment part 58 has a higher mechanical strength than the sealing body 50 itself, to prevent damage to the sealing member 48 when the first push-button cover 36 and the first push-pin 38 move. In other words, the structural design of at least one embodiment of the present invention whereby the first abutment part 58 has a larger thickness may be used to increase the service life of the sealing member 48. In this embodiment, the first abutment part 58 may be a platform structure, but the embodiments of the present invention are not limited to this.

In addition, since the first abutment part 58 of the sealing member 48 is clamped between the first trigger part 365 of the first push-button cover 36 and the first push-pin 38, there is little relative movement between the first abutment part 58 and the first trigger part 365 and between the first abutment part 58 and the first push-pin 38 when the first trigger part 365 of the first push-button cover 36 drives the first push-pin 38 via the first abutment part 58 so as to trigger the switch in the push-button base 32, thus the structural design of the first abutment part 58 in the present invention can reduce friction between the first abutment part 58 and the first trigger part 365 and between the first abutment part 58 and the first push-pin 38, so as to further increase the service life of the sealing member 48. Practical testing has found that the sealing member 48 of the present invention can tolerate being pressed by the first push-button cover 36 more than 5 million times.

In addition, the sealing member 48 further comprises a second abutment part 60, and the second push-button cover 40 has a second trigger part 405. The second abutment part 60 is disposed in a position on the sealing body 50 which corresponds to the second push-pin 42, and two sides of the second abutment part 60 protrude from the first surface 501 and the second surface 503 of the sealing body 50. When a user presses the second push-button cover 40, the two sides of the second abutment part 60 can abut the second trigger part 405 of the second push-button cover 40 and the second push-pin 42 respectively, so that the second trigger part 405 of the second push-button cover 40 drives the second push-pin 42 via the second abutment part 60, to trigger a switch in the push-button base 32 (not shown in the figures).

It is worth mentioning that since the two sides of the second abutment part 60 protrude from the first surface 501 and the second surface 503 of the sealing body 50, i.e. the thickness of the second abutment part 60 is greater than the thickness of the sealing body 50, the second abutment part 60 has a higher mechanical strength than the sealing body 50 itself, to prevent damage to the sealing member 48 when the second push-button cover 40 and the second push-pin 42 move. In other words, the structural design of the present invention whereby the second abutment part 60 has a larger thickness may be used to increase the service life of the sealing member 48. In this embodiment, the second abutment part 60 may be a platform structure, but the embodiments of the present invention are not limited to this.

In addition, since the second abutment part 60 of the sealing member 48 is clamped between the second trigger part 405 of the second push-button cover 40 and the second push-pin 42, there is little relative movement between the second abutment part 60 and the second trigger part 405 and between the second abutment part 60 and the second push-pin 42 when the second trigger part 405 of the second push-button cover 40 drives the second push-pin 42 via the second abutment part 60 so as to trigger the switch in the push-button base 32, thus the structural design of the second abutment part 60 in the present invention can reduce friction between the second abutment part 60 and the second trigger part 405 and between the second abutment part 60 and the second push-pin 42, so as to further increase the service life of the sealing member 48. Practical testing has found that the sealing member 48 of the present invention can tolerate being pressed by the second push-button cover 40 more than 5 million times.

In addition, the sealing body 50 of the sealing member 48 further has an elastic connecting part 505, which connects the first abutment part 58 with the second abutment part 60, and can be used to provide elasticity, so that the first abutment part 58 and the second abutment part 60 move up and down. In this embodiment, the cross section of the elastic connecting part may be a U-shaped structure, but the structural design of the elastic connecting part 505 in the present invention need not be limited to that shown in the accompanying drawings of this embodiment.

Compared to the prior art, the sealing mechanism of the present invention utilizes the front ring shell and the lamp base shell to respectively compress the periphery of the sealing body of the sealing member during assembly, so that the sealing body and the front ring shell together form a sealing space, to seal the first slot and the second slot in the push-button base. Thus, the sealing member can be used to seal the first slot and the second slot in the push-button base, to block the ingress of foreign matter (e.g. water or dust) into the interior of the push-button base of the push-button device, to further prevent foreign matter from causing damage to a push-button assembly as a result of entering the interior of the push-button base.

The above embodiments are merely preferred embodiments of the present invention, which are not intended to limit it. As far as those skilled in the art are concerned, various alterations and changes could be made to the present invention. Any amendments, equivalent substitutions or improvements etc. made within the spirit and principles of the present invention should be included in the scope of protection thereof.

The invention claimed is:

1. A sealing mechanism suitable for use in a push-button device, the push-button device comprising a push-button base, the sealing mechanism comprising:

a front ring shell, mounted on the push-button base;

a lamp base shell, removably mounted on the front ring shell; and a sealing member, including a sealing body, wherein when the lamp base shell is mounted on the front ring shell, the periphery of the sealing body is sandwiched between the lamp base shell and the front ring shell, so that the sealing body and the front ring shell together form a sealing space, to seal a first slot in the push-button base.

2. The sealing mechanism of claim 1, wherein the sealing body includes a first surface and a second surface opposite the first surface, the first surface and the second surface abutting a first push-button cover and a first push-pin of the push-button device respectively, and the second surface and the front ring shell together defining the sealing space.

3. The sealing mechanism of claim 2, wherein the sealing member further comprises:

a first abutment part, disposed in a position on the sealing body which corresponds to the first push-pin, and two sides of the first abutment part protrude from the first surface and the second surface and abut the first push-button cover and the first push-pin respectively.

4. The sealing mechanism of claim 3, wherein the thickness of the first abutment part is relatively greater than the thickness of the sealing body.

5. The sealing mechanism of claim 4, wherein the sealing space is further configured to seal a second slot in the push-button base, and the first surface and the second surface further abut a second push-button cover and a second push-pin of the push-button device respectively, and wherein the sealing member further comprises:

a second abutment part, disposed in a position on the sealing body which corresponds to the second push-pin, and two sides of the second abutment part protrude from the first surface and the second surface and abut the second push-button cover and the second push-pin respectively.

6. The sealing mechanism of claim 5, wherein the sealing body further includes an elastic connecting part, connecting the first abutment part and the second abutment part.

7. The sealing mechanism of claim 1, wherein the sealing member further comprises:

a first rib part, disposed at the junction of the sealing body and the sealing wall and projecting towards the lamp base shell.

8. The sealing mechanism of claim 7, wherein the sealing member further comprises:

a second rib part, disposed at the junction of the sealing body and the sealing wall and projecting towards the front ring shell.

9. The sealing mechanism of claim 1, wherein the lamp base shell includes a fixing ring structure, surrounded by the sealing wall.

10. The sealing mechanism of claim 9, wherein the lamp base shell further includes multiple engagement hook structures, which engage the front ring shell, so that the fixing ring structure pushes down the periphery of the sealing body against the front ring shell.

11. A push-button device, comprising:

a push-button base, in which a first slot is formed; and a sealing mechanism, wherein the sealing mechanism includes:

a front ring shell, mounted on the push-button base;

a lamp base shell, removably mounted on the front ring shell; and a sealing member, the sealing member including:

a sealing body;

wherein when the lamp base shell is mounted on the front ring shell, the periphery of the sealing body is sandwiched between the lamp base shell and the front ring shell, so that the sealing body and the front ring shell together form a sealing space, to seal the first slot in the push-button base.

12. The push-button device of claim 11, further comprising:

a first push-button cover; and a first push-pin, the first push-button cover being disposed above the lamp base shell, the first push-pin being slidably disposed in the first slot and corresponding to the first push-button cover, the sealing body including a first surface and a second surface opposite the first surface, the first surface and the second surface abutting the first push-button cover and the first push-pin respectively, and the second surface and the front ring shell together defining the sealing space.

13. The push-button device of claim 12, wherein the sealing member further comprises:

a first abutment part, disposed in a position on the sealing body which corresponds to the first push-pin, and two sides of the first abutment part protruding from the first surface and the second surface and abutting the first push-button cover and the first push-pin, respectively.

14. The push-button device of claim 13, wherein a thickness of the first abutment part is relatively greater than a thickness of the sealing body.

15. The push-button device of claim 14, wherein a second slot is further formed in the push-button base, the sealing space further seals the second slot in the push-button base, the push-button device further comprises a second push-button cover and a second push-pin, the second push-button cover being disposed above the lamp base shell and being adjacent to the first push-button cover, the second push-pin being slidably disposed in the second slot and corresponding to the second push-button cover, and the first surface and the second surface abut the second push-button cover and the second push-pin respectively, and the sealing member further comprises:

a second abutment part, disposed in a position on the sealing body which corresponds to the second push-pin, and two sides of the second abutment part protrude from the first surface and the second surface and abut the second push-button cover and the second push-pin respectively.

16. The push-button device of claim 15, wherein the sealing body further includes an elastic connecting part, connecting the first abutment part and the second abutment part.

17. The push-button device of claim 11, wherein the sealing member further comprises:

a first rib part, disposed at a junction of the sealing body and the sealing wall and projecting towards the lamp base shell.

18. The push-button device of claim 17, wherein the sealing member further comprises:

a second rib part; disposed at a junction of the sealing body and the sealing wall and projecting towards the front ring shell.

19. The push-button device of claim 11, wherein the lamp base shell includes a fixing ring structure surrounded by the sealing wall.

20. The push-button device of claim 19, wherein the lamp base shell further includes multiple engagement hook structures, which when engaged with the front ring shell, cause the fixing ring structure to push down a periphery of the sealing body against the front ring shell.

21. The push-button device of claim 12, wherein the sealing member further comprises:

a first rib part, disposed at a junction of the sealing body and the sealing wall and projecting towards the lamp base shell.

22. The push-button device of claim 21, wherein the sealing member further comprises:

a second rib part, disposed at a junction of the sealing body and the sealing wall and projecting towards the front ring shell.

23. The push-button device of claim 12, wherein the lamp base shell includes a fixing ring structure surrounded by the sealing wall.

24. The push-button device of claim 23, wherein the lamp base shell further includes multiple engagement hook structures, which when engaged with the front ring shell, cause the fixing ring structure to push down a periphery of the sealing body against the front ring shell.

25. The sealing mechanism of claim 1, wherein the sealing member further includes a sealing wall, annularly disposed on the sealing body and fixed to the lamp base shell.

* * * * *